US005586540A

United States Patent [19]

Marzec et al.

[11] Patent Number: 5,586,540

[45] Date of Patent: Dec. 24, 1996

[54] MULTIPLE STAGE SUPERCHARGING SYSTEM

[76] Inventors: Steven E. Marzec; Willy Marzec, both of 5761 Musket La., Stone Mountain, Ga. 30087

[21] Appl. No.: 521,297

[22] Filed: Aug. 29, 1995

[51] Int. Cl.[6] ..... F02B 33/40; F02B 39/10

[52] U.S. Cl. ..... 123/559.1; 123/562; 123/565

[58] Field of Search ..... 60/607, 608; 123/559.1, 123/562, 565

[56] References Cited

U.S. PATENT DOCUMENTS

| | | | |
|---|---|---|---|
| 2,503,289 | 4/1950 | Nettel | 60/607 |
| 3,948,234 | 4/1976 | Shumaker, Jr. . | |
| 4,253,031 | 2/1981 | Frister . | |
| 4,453,524 | 6/1984 | Lee . | |
| 4,724,817 | 2/1988 | Cook . | |
| 4,745,755 | 5/1988 | Kawamura . | |
| 4,757,686 | 7/1988 | Kawamura et al. . | |
| 4,833,887 | 5/1989 | Kawamura et al. . | |
| 4,907,552 | 3/1990 | Martin . | |
| 5,083,040 | 1/1992 | Whitford et al. . | |
| 5,121,605 | 6/1992 | Oda et al. . | |
| 5,140,816 | 8/1992 | Scicluna | 123/559.1 |
| 5,214,333 | 5/1993 | Kawamura . | |
| 5,368,004 | 11/1994 | Mann | 123/559.1 |

FOREIGN PATENT DOCUMENTS

| | | | |
|---|---|---|---|
| 1070328 | 1/1984 | U.S.S.R. | 123/565 |
| 92/21869 | 12/1992 | WIPO | 60/608 |

*Primary Examiner*—Michael Koczo
*Attorney, Agent, or Firm*—Hinkle & Associates, P.C.

[57] ABSTRACT

A multiple stage supercharging system is disclosed suitable for both two-stroke cycle and four-stroke cycle internal combustion engines. Ambient air, which is propelled by the forward velocity of the engine, enters an air cleaner housing (11) through an air filter. The air cleaner housing (11) attaches to the air intake (32) of a centrifugal compressor (12). The centrifugal compressor (12) mounts directly to the magnetic flywheel on the crankshaft of the engine. The centrifugal compressor wheel (22) pressurizes the ambient air for use in the combustion process. The outlet of the centrifugal compressor housing mates with a secondary plenum chamber (17). The outlet of the secondary plenum chamber (17) mates with a d.c. motor driven axial compressor (28). The axial compressor (28) operates on current derived from a motor driven alternator (38). The outlet of the axial compressor connects to a primary plenum chamber (18) which connects to the air intake snorkel on the carburetor. A pressure equalization tube (19) extends from the primary plenum chamber to the carburetor bowl to allow for consistent flow of the air/fuel mixture to the crankcase. The system provides for multiple compressors to generate layers of additive pressure for supercharging an internal combustion engine. The system provides air pressure to boost the power output of the engine across the entire rpm band by utilizing the centrifugal compressor (12) and the axial compressor (28) at low speeds and by utilizing forward air velocity air intake pressure plus the centrifugal and axial compressors at high speeds.

21 Claims, 5 Drawing Sheets

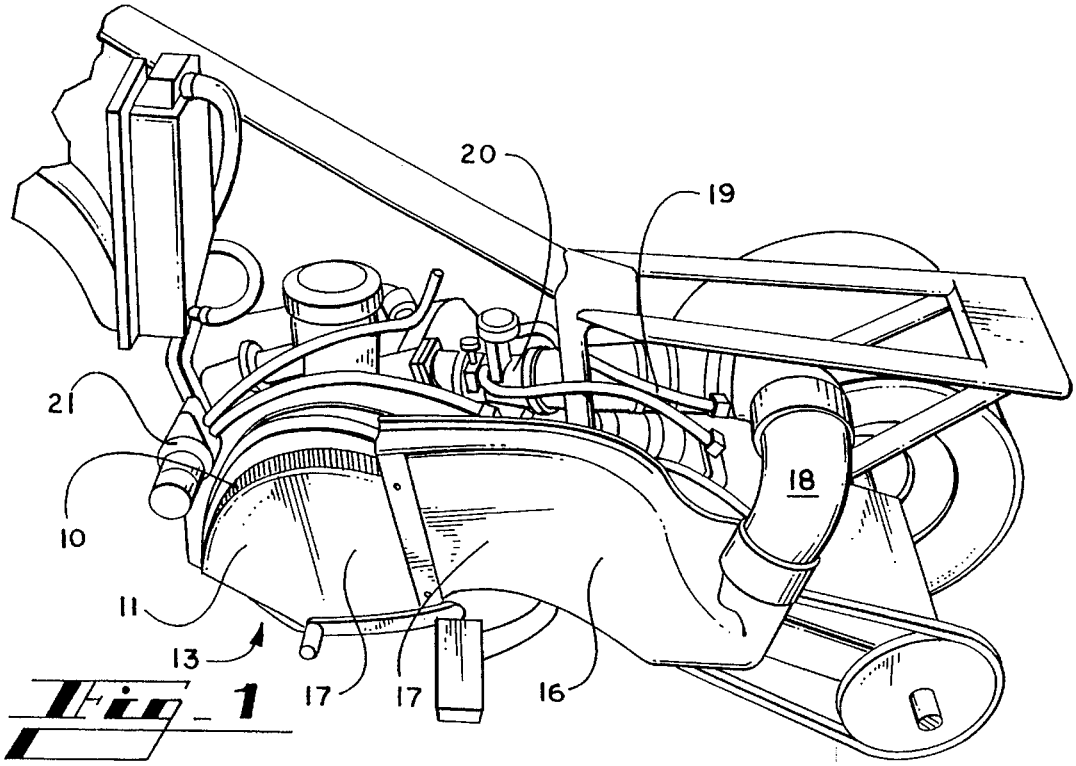
Fig_1
Fig_2
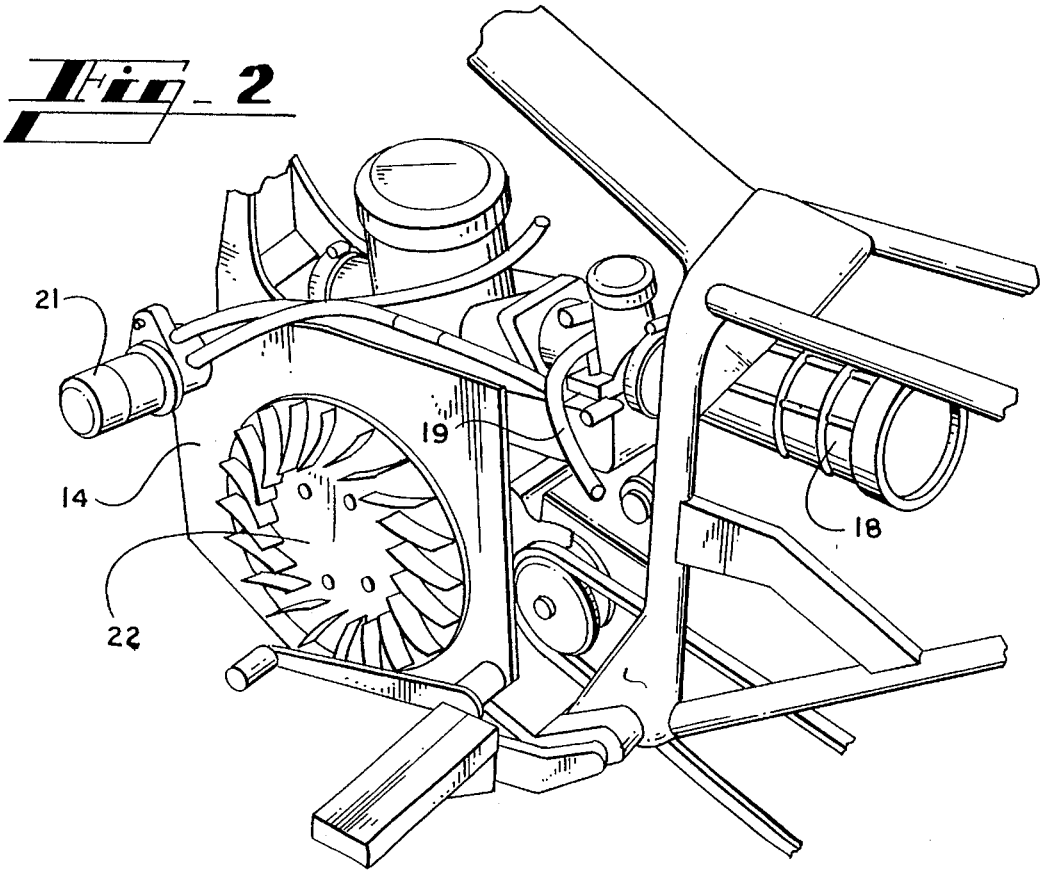

MULTIPLE STAGE SUPERCHARGING SYSTEM

BACKGROUND OF THE INVENTION

I. Field of the Invention

The present invention relates to a supercharging system for both 2-stroke cycle and 4-stroke cycle internal combustion engines.

II. Description of the Related Art

A supercharger is a device for increasing the power output of internal combustion engines. A supercharger compresses air or a mixture of fuel and air and forces it into the cylinders of the engine at a pressure greater than the pressure of the atmosphere. This compression increases the amount of air and fuel that can be burned at one time in the combustion chamber. There are two main types of superchargers. In positive displacement superchargers, the air is compressed by rotating cams, rotating vanes, or a piston. This type of supercharger is used on ground based engines and is driven from the crankshaft by gears or belts. These superchargers are mechanically complex, and therefore, due to space and weight restrictions associated with performance, they are difficult to incorporate into certain vehicles. Also, a positive displacement unit absorbs a substantial portion of engine horsepower and requires a mechanical wastegate to relieve excess pressure.

The second main type of supercharger is commonly referred to as the turbocharger. The turbocharger is used mainly on diesel engines and on airplane piston engines because it is light and compact. The turbocharger is also used with high performance automobiles, select motorcycles and certain race vehicles. With the turbocharger, the exhaust gases drive a compressor wheel to create the supercharging effect. This exhaust driven system (non-positive displacement or free floater) must generate sufficient exhaust pressures to generate a smooth and even flow of exhaust gases. To accomplish a smooth and even flow of exhaust gases, the turbo compressor generally starts pressure generation at approximately forty thousand (40,000) rpm and operates up to one hundred fifty thousand (150,000) rpm. The time necessary to accelerate to these speeds represents a lag factor. This lag factor usually affects the acceleration by compressing air late in the rpm cycle, and therefore, the turbocharger does not significantly increase performance at lower rpm's. This problem is most prevalent in small combustion engines because exhaust pulses are not frequent or smooth enough to generate the necessary compressor speeds.

A third supercharging method uses frontal air velocity to generate positive intake pressure. This system is completely dependent on forward vehicle velocity to generate intake pressure. At zero velocity (assuming no wind), no pressure is generated. As forward velocity increases, the pressure also increases at a proportional rate. At low velocities, the amount of pressure generated is too small to be of any practical use. Also, at high altitudes where the density of air decreases, the air pressure generated by forward velocity diminishes at a greater rate than the air pressure generated using mechanically driven compressors.

In order to derive substantial benefits from supercharging, the pressures between the carburetor float bowl and the primary plenum chamber of a supercharger should be balanced. A system that does not balance these pressures such as U.S. Pat. No. 4,907,552 issued to Martin can only work at pressures up to about a quarter of an inch of water. At pressures above a quarter of an inch of water, balancing these pressures becomes an absolute requirement. In an unbalanced condition, air flow, under pressure from the plenum chamber, creates a differential air pressure from the carburetor venturi to the fuel float bowl and fuel ceases to flow through the carburetor.

The multistage supercharger of the present invention produces better results for smaller engines (especially two-stroke cycle) than the prior art superchargers by combining a forward air pressure intake, a mechanical centrifugal compressor (non-positive displacement), and an electronically controlled axial flow compressor to yield a complete pressure spectrum across the entire rpm band, and by balancing the pressures between the carburetor fuel float bowl and the primary plenum chamber.

SUMMARY OF THE INVENTION

The system of the present invention starts with an air intake housing attached to a centrifugal compressor housing. The air intake housing is positioned to take advantage of the forward air pressure that is proportional to the forward velocity of the engine. The air entering the supercharger through the air intake housing is filtered by an air cleaner.

After the air is filtered and passes through the air intake housing, the air enters the centrifugal compressor through a round opening in the center of the housing. The compressor unit is bolted directly to the magnetic flywheel of the combustion engine crankshaft. The compressor housing is mounted to a backing plate which attaches to the engine case. The compressor wheel is bolted to the flywheel. The outlet of the mechanical compressor is ducted to an electronic compressor unit. This ducted area from the electronic compressor unit up to and including the centrifugal compressor housing comprises a secondary plenum chamber.

The duct from the centrifugal compressor makes a smooth turn and is integrated with an electronically controlled axial compressor. The axial compressor wheel is powered by the output of an electrical stator and an electrical d.c. motor which is directly coupled to the axial compressor. The stator collects electrical energy for the d.c. motor from the magnetic flywheel of the engine crankshaft. The current from the a.c. stator is passed through a rectifying circuit to convert a.c. to d.c. current. The converted current goes to the d.c. motor which drives the axial compressor.

The primary plenum chamber connects to the outlet of the electronic axial compressor at one end and to the air intake on the carburetor at the other end. The primary plenum chamber has a set of holes in the front top portion which are used to connect tubes to the carburetor. These tubes provide for pressure equalization between the primary plenum chamber and the float chamber of the carburetor.

Any one of the compressor units may stand alone, if such arrangement is required by space or energy constraints. For example, a 40 c.c. moped does not generate enough power to draw 250 watts of power for the electronic axial compressor. Therefore, a light weight mechanical (centrifugal type) fan with a small ducted housing is the best option.

Due to the requirements of the foot pedal location for motorcross cycles, these cycles cannot be widened by two to three inches to accommodate a centrifugal mechanical compressor attached to the flywheel, in this situation, a small axial compressor unit is the most practical choice for compressors.

Also, the forward air collector, mechanical centrifugal compressor and electronic axial compressor may be mixed and matched in a multitude of different combinations. These combinations may include one, two or all three of the elements.

As a result of the multiple stage supercharging system, an enhanced air to fuel mixture is inducted into the crankcase in a two cycle engine. This enhanced air to fuel mixture generates higher rear wheel horsepower as measured during tests utilizing the Dynojet 100. A stock Honda ATC 250R yielded 28.6 hp during the test, and the same Honda ATC 250R equipped with the multiple stage supercharger of the present invention yielded 32.4 hp. These numbers are based on an average of the peak horsepower values through all of the gears. The result is a 13.3 percent gain in horsepower. This horsepower data represents a first generation test, and improvements in the design of the plenum chamber may provide an additional improvement in the overall horsepower gain.

The multiple stage supercharging system improves the combustion efficiency of a two-stroke cycle engine. Normally two-stroke cycle engines must run on a richer air to fuel ratio to maintain a balance between maximum efficiency and maximum engine life. This relationship is also a result of the method used for carburetion. The carburetion in a standard two-stroke cycle engine does not allow for a precise balance of fuel to air over the entire rpm band. The reason for the lack of balance is the lack of sustained equalization of the pressures between the carburetor fuel float and the air intake of the carburetor venturi. As a result, carbon builds up in the cylinder head of normally aspirated two-stroke cycle engines at the rate of approximately one millimeter per every ten to fifteen hours of normal use. Normal use is defined as the following percentage of time spent in each rpm range: ten percent in the 1000–3000 rpm range, fifty percent in the 3000–5000 rpm range, and forty percent in the 5000–8000 percent range. The multiple stage supercharging system of the present invention enhances the volumetric efficiency of the carburetion and increases the combustion efficiency of the engine. Using the multiple stage supercharging system of the present invention with all conditions being equal as stated above for the standard two-stroke cycle engine, the buildup of carbon is virtually eliminated. The combustion efficiency of the present invention is also confirmed by the spark plug color. The spark plug color for an engine using the system of the present invention is a light brown color which indicates a well balanced air to fuel ratio. Further, confirmation of the combustion efficiency is found by exhaust temperature analysis and horsepower data derived from dyno testing.

Under normally aspirated conditions, an engine must draw on its own inertia momentum to create a vacuum to pull the air/fuel mixture into the crankcase and then to push the mixture into the combustion chamber. The work required to create this vacuum results in a lower total engine output. Also, because a vacuum must be generated to pull the air/fuel mixture into the crankcase of a two-stroke cycle engine, the air molecules are less dense which also results in lower combustion efficiency. By creating elevated pressures in the primary plenum chamber, the multiple stage supercharging system of the present invention reduces the need for the engine to draw upon its inertial momentum to draw air into the crankcase.

For a two-stroke cycle engine undergoing a power stroke, the air/fuel mixture in the crankcase is compressed to greater pressures by the system of the present invention than under any normally aspirated engine. As a result of this greater pressure generated in the crankcase, the air/fuel mixture is transferred to the combustion chamber quicker and the air/fuel mixture is denser than normal which increases the efficiency of the combustion.

The two-stroke cycle engine has an open crankcase into which the fuel and air charge is inducted. As the fuel mixture is ignited in the combustion chamber, a force is created which moves the piston downward. At the same time, a new charge of air and fuel, under pressure from the multistage supercharger, creates a force on the piston from the underside pushing upward, the force exerted creates enough resistance to cushion the piston and help decelerate the piston. This cushioning effect causes the ignited fuel and air in the combustion chamber to be placed under greater pressure which increases the combustion efficiency of the engine. Also, due to the increased pressure in the crankcase, the piston is accelerated upward with greater velocity which increases the combustion efficiency of the engine. The following results indicate the cushion and acceleration effect described above: a base 300 c.c. engine develops a sixty-three degree (63°) slope in the acceleration curve and the multistage supercharged version develops a seventy-five degree (75°) slope according to a fourth gear roll-on dyno test.

Although the system of the present invention has primary application to two-stroke cycle engines, the same principles of multiple stage supercharging would apply to four-stroke cycle engines as well.

Accordingly, it is an object of the present invention to use multiple compressors to generate layers of additive pressure for supercharging an internal combustion engine.

Another object of the invention is to provide for adequate air pressure to boost the power output of an internal combustion engine across the entire rpm band by utilizing pressure generating systems which include the forward air velocity, a mechanical centrifugal compressor and an electric axial flow compressor.

It is another object of the present invention to prevent the pressure lag associated with gear changes which can occur with a supercharger that is based entirely on a mechanical compressor unit that is driven by the engine crankshaft.

It is another object of the present invention to provide an electronic axial compressor for pressurizing the primary plenum chamber before the centrifugal compressor tied to the crankshaft has sufficient rpm to become the dominant pressure source.

It is another object of the present invention to provide an enhanced air to fuel mixture to the cylinders of a two or four-stroke cycle engine to enhance the power output of the engine.

It is another object of the present invention to increase the combustion efficiency of an internal combustion engine by increasing the atomization of fuel from the carburetor venturi which increases the surface area of fuel particles thereby allowing for a more efficient burning flame-front and more complete combustion.

It is another object of the present invention to create a larger pressure differential between the crankcase and the carburetor throttle to enable a denser air/fuel mixture to enter the combustion chamber.

It is another object of the present invention to optimize the velocity of the air/fuel mixture through the venturi section of the carburetor to produce a greater ram effect between each combustion cycle.

It is another object of the present invention to reduce the losses associated with engine performance at different altitudes above sea level by pressurizing the air through the intake system.

These and other objects, features and advantages of the present invention may be more clearly understood and appreciated from a review of the following detailed description of the disclosed embodiment and by reference to the appended drawings and claims.

BRIEF DESCRIPTION OF THE DRAWINGS

FIG. 1 is a perspective partial view of a vehicle equipped with the multiple stage supercharging system of the present invention;

FIG. 2 is a perspective partial view of the supercharging system of the present invention with the centrifugal compressor housing removed to reveal the compressor wheel mounted to the flywheel of the engine;

DESCRIPTION OF THE PREFERRED EMBODIMENTS

Figure 3:
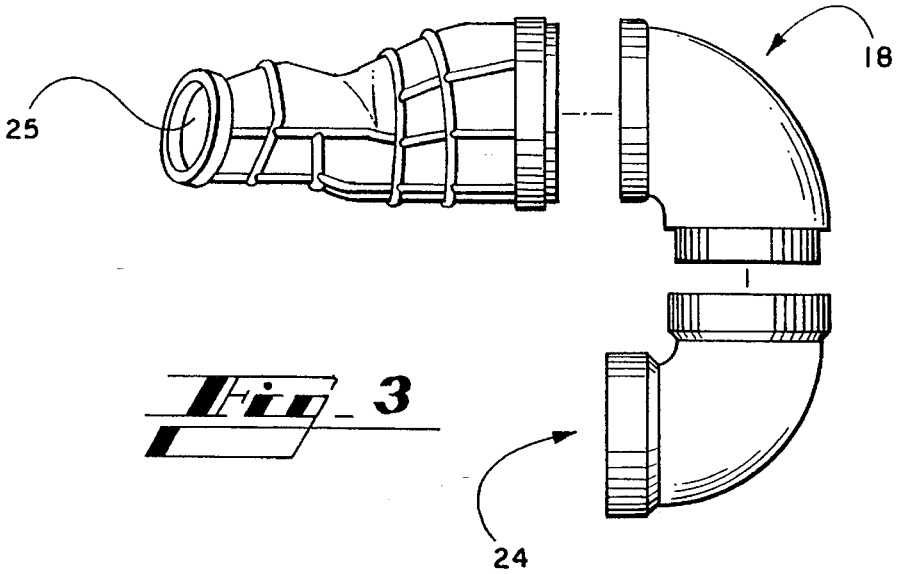
FIG. 3 is a side view of the primary plenum chamber.

Referring to the drawings wherein like reference numerals designate corresponding parts throughout the several figures, and referring initially to FIG. 1, the process will commence with ambient air entering a centrifugal compressor housing 13 through an air cleaner 10. The air filter 10 is enclosed by an air cleaner housing 11. The air intake of the air cleaner housing 11 is positioned to take advantage of the forward air pressure that is proportional to the forward velocity of the engine. In this manner, the forward air velocity can be utilized to add to the pressures developed downstream in the system. The relationship between forward velocity and air pressure is described in Table 1.

TABLE 1

| AIR PRESSURES AT DIFFERING AIR VELOCITIES | |
|---|---|
| MPF (Sea Level) | PRESSURE (inches of H2O) |
| 10 | 0.05 |
| 20 | 0.19 |
| 40 | 0.77 |
| 60 | 1.7 |

TABLE 1-continued

| AIR PRESSURES AT DIFFERING AIR VELOCITIES | |
|---|---|
| MPF (Sea Level) | PRESSURE (inches of H2O) |
| 80 | 3.1 |
| 100 | 4.8 |
| 120 | 6.9 |
| 140 | 9.4 |
| 160 | 12.3 |
| 180 | 15.5 |
| 200 | 19.2 |
| 300 | 43.2 |
| 400 | 76.7 |

The charge of air generated by the forward velocity of the engine passes through the air filter 10 and enters the mechanical centrifugal compressor 12. The air cleaner 10 and air cleaner housing 11 of the present invention may be replaced with many types of air scoops and air filters which are available in the prior art. The centrifugal compressor housing 13 attaches to a backing plate 14 which is mounted on the exterior of the engine crankcase 15 (shown in FIG. 9). The backing plate 14 is preferably constructed of aluminum and has a series of holes for mounting the centrifugal compressor housing 13.

The centrifugal compressor housing 13 has an outlet at one end which connects with a transition duct 16. The transition duct 16 forms a round opening at its outlet. The total chamber area including the centrifugal compressor housing and the transition duct 16 to its outlet comprises the secondary plenum chamber 17. This secondary plenum chamber 17 acts as a large reservoir for air pressure. The outlet of the secondary plenum chamber mates with the rear of the primary plenum chamber 18. At the opposite end of the primary plenum chamber 18, the OEM air intake snorkel to the carburetor is maintained intact.

An air valve (not shown) is inserted in the lower portion of the primary plenum chamber 18 to be connected to a manometer for monitoring the air pressure in the chamber. Toward the front of the primary plenum chamber 18, two 0.375 diameter holes are fitted with vinyl tubing 19 which runs to the carburetor 20 for pressure equalization between the intake air to the carburetor 20 and the air in the bowl of the carburetor 20. This balanced setup keeps the carburetor float bowl pressure equal to the pressures in the primary plenum chamber 18. As a result, fuel can flow through the carburetor under all conditions including vacuum and pressurized conditions. It is important to position the balance tubes in the least turbulent area of the primary plenum chamber 18.

Due to the increased plenum pressures generated by the additional compressors in the supercharging system, the use of an electric fuel pump 21 is necessary for the system to operate. Once the pressures in the primary plenum chamber 18 and the carburetor 20 exceed the head pressure exerted by a gravity fed fuel system, the fuel must be pumped to the carburetor to overcome the pressures.

The two-stroke cycle engine has an open crankcase where a normal fuel and air charge is inducted. As the fuel mixture is ignited in the combustion chamber, a force is created which moves the piston in the downward direction. At the same time a new charge of air and fuel entering the crankcase creates a force on the piston from the underside pushing upward. With the multiple stage supercharging system, the new charge of air and fuel in under increased pressure and the force exerted by the charge creates enough resistance to cushion the piston and help decelerate the piston. This pressure of the new charge of air and fuel from underneath the piston creates two effects. First, the ignited fuel and air in the combustion chamber is placed under greater pressure increasing combustion efficiency. Second, as the piston reaches the bottom of its stroke it is accelerated upward with greater velocity increasing efficiency and performance.

Figures 9, 10:
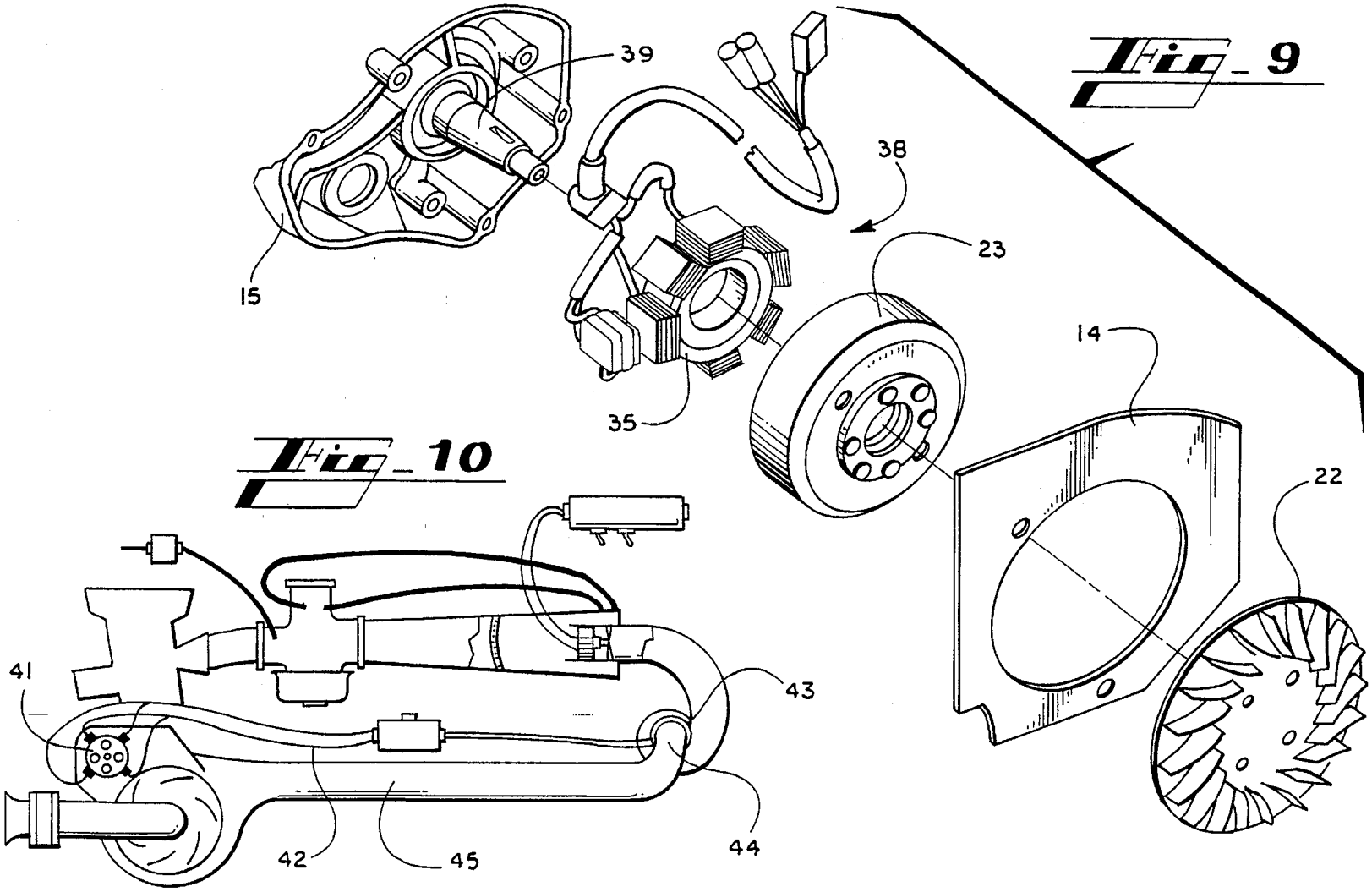
FIG. 9 is an exploded perspective view of the crankcase, stator, flywheel, backing plate and compressor wheel of the present invention.
FIG. 10 is a schematic diagram of the supercharging system of the present invention equipped with a belt driven d.c. generator and a tertiary plenum chamber.

Referring to FIG. 2, the centrifugal compressor wheel 22 is mounted directly to the magnetic flywheel of the engine (best shown in FIG. 9). The backing plate 14 is mounted to the engine case. The electric fuel pump 21 has a fuel line to the gas tank (which has been removed) and a fuel line to the carburetor 20. A portion of the primary plenum chamber 18 has been removed and therefore, the vinyl tubing 19 for pressure equalization between the bowl of the carburetor and the primary plenum chamber 18 is shown broken away.

FIG. 3 is a detail drawing of the primary plenum chamber 18 which mates with the secondary plenum chamber at its inlet 24 and mates with the OEM carburetor snorkel at its outlet 25. The chamber is preferably constructed of three inch O.D. ABS tubing with two elbows in the line to make the turn from the secondary plenum chamber to the carburetor snorkel.

Figure 4:
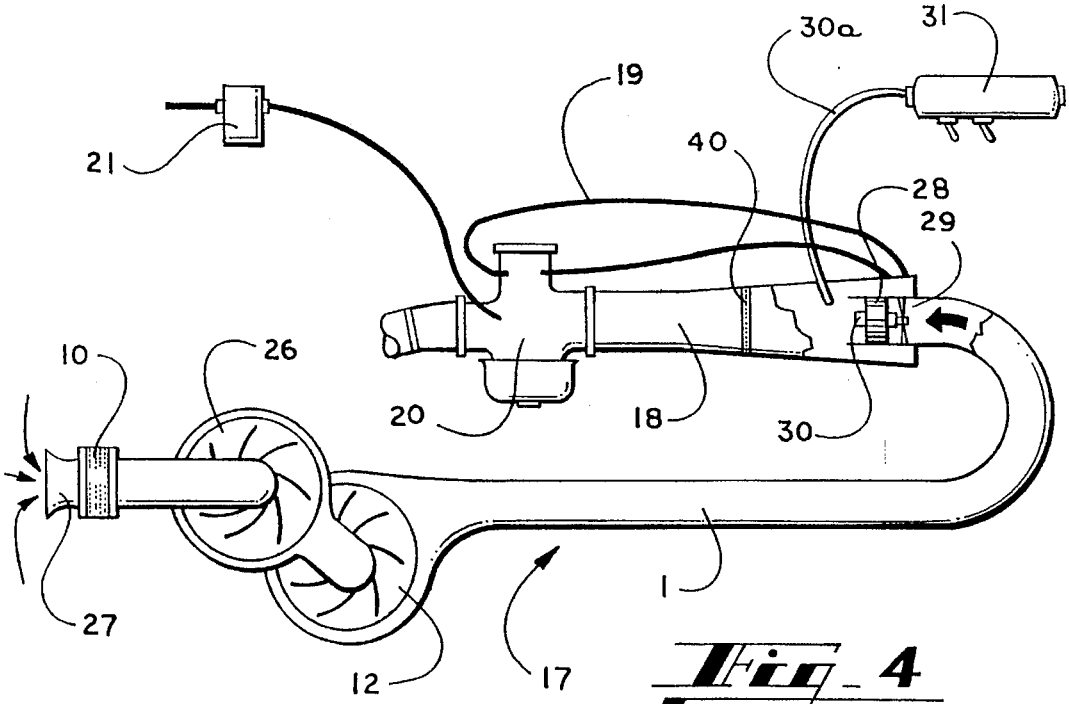
FIG. 4 is a schematic diagram of the supercharging system of the present invention equipped with an additional mechanical centrifugal compressor.

FIG. 4 is a schematic of the supercharging system of the present invention with a second mechanical centrifugal compressor 26 which is driven by a belt from the crankshaft of the engine (the belt is not shown). The ambient air enters an air scoop 27 and passes through the air cleaner 10 to the second centrifugal compressor 26. The air enters the second centrifugal compressor housing and exits to the first centrifugal compressor 12 which is mounted directly to the magnetic flywheel 20 of the engine. The secondary plenum chamber 17 comprises the first centrifugal compressor housing and the transition duct 16 up to a d.c. motor driven axial compressor 28, which divides the secondary plenum chamber 17 from the primary plenum chamber 18. The compressor 28 is mounted to the rear of the primary plenum chamber 18. The compressor unit is mounted to a 2.9 inch diameter opening. Near the periphery of this opening, a set of compressor module lock rings hold and position the unit rigidly in place. At the opposite end of the primary plenum chamber, the OEM air intake snorkel to the carburetor is maintained intact. In order to screen out foreign objects and provide for greater turbulence reduction, a wire mesh screen 40 can be introduced between the carburetor 20 and the axial compressor 28 in the primary plenum chamber 18. The wire mesh screen 40 is preferably constructed of stainless steel wire with a 0.005 inch diameter and a grid pattern consisting of 0.015 inch square spacing.

The axial compressor 28 receives pressurized air from the secondary plenum chamber 17, and further pressurizes the air as it enters the primary plenum chamber 18. The compressor 28 acts partly as a pressure regulator for the primary plenum chamber 18. When both plenum chambers are fully pressurized at high rpm and a gear change occurs, the engine rpm drops which in turn slows the crankshaft compressor 12. As a result the secondary plenum chamber 17 drops in pressure, but the compressor 28 retains the pressure in the primary plenum chamber 18 long enough to allow the crankshaft compressor 12 to regain its new rpm pressure range. This pressure supply by the compressor 28 eliminates the pressure lag associated with gear changes that occurs with a supercharger based solely on the crankshaft compressor unit. Also, at low rpm the compressor unit 28 precharges the primary plenum chamber 18 until the crankshaft compressor rpm becomes large enough to become the dominant pressure source. The compressor wheel 29 consists of a high quality aluminum air turbo compressor wheel that has been highly modified. Approximately one half of the rear portion of the compressor wheel is cut off. The remaining front portion is finished to a weight of approximately one and a half ounces. The finished compressor wheel 29 consists of a six bladed axial flow compressor wheel with each blade spaced at sixty degree intervals around a radially secured hub. Spaced between each blade, a partial or cheater blade is similar in design to a jet turbine engine blade. The total number of blades is twelve, and the blades are spaced equally around a center hub. The designed maximum operating speed is 28,000 rpm, and the compressor wheel diameter is 2.430 inches. The barrel in which the compressor 28 is rotating is 2.480 inches in diameter which results in a separation of 0.50 inches between the compressor blades and the wall. Another feature of the barrel is that the opening is cut at a taper of twenty three degrees parallel to air flow for a smooth air transition. The compressor wheel 20 is sized to mount on a hub which is sized to mount on the output shaft of the electric d.c. motor 30. The d.c. motor is preferably a rare earth magnet type with Silver graphite brushes to maximize the life and performance of the motor.

A compressor motor tripod (not shown) is made of aluminum and serves three principal functions. First, the tripod provides a rigid and accurately positioned housing for the d.c. motor. Second, the aluminum of the tripod acts as a heat sink for the electric d.c. motor. Third, and most importantly, the three legs serve as airflow straighteners which prevent the air from circulating in the compressor barrel and direct the air in the axial flow direction. The legs of the tripod must be at least 0.70 inches in width to perform their functions properly. The trailing side of each leg is radiused or tapered for improved air flow from low engine rpm to high engine rpm.

The wires 30*a* that connect to the d.c. motor 30 on the axial compressor 28 lead to a manual switching station 31. The manual switching station has two toggle switches which allow for adjustment between three levels of power to the compressor. The minimum current goes to the compressor when both switches are turned off. An intermediate level is available when one switch is turned on and the other switch is turned off. The maximum current is provided to the compressor when both switches are turned on.

An electric fuel pump 21 is required to overcome the head pressures created in the carburetor 20 and the primary plenum chamber 18.

Figure 5:
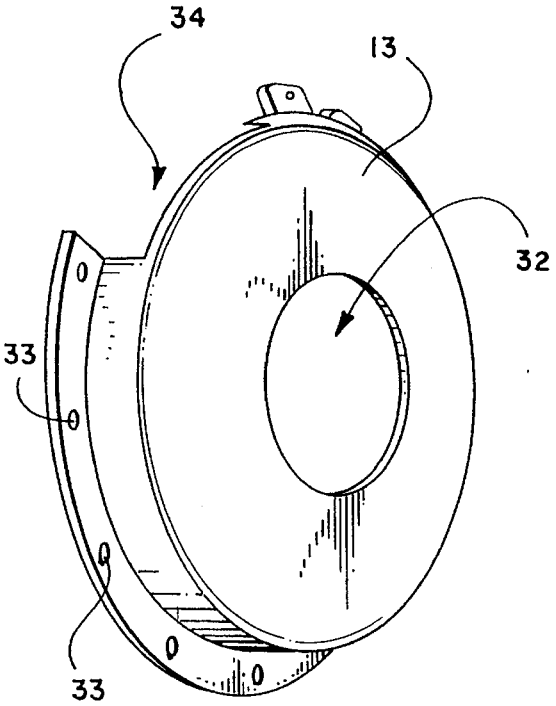
FIG. 5 is a perspective view of the centrifugal compressor housing.

In FIG. 5, the centrifugal compressor housing 13 for the first and second centrifugal compressors is shown. The air intake opening 32 is shown as a round opening in the center which is preferably about 3.6 inches in diameter. The opening is preferably fitted with a fine mesh stainless steel filter (not shown). The perimeter of the housing has a series of holes 33 which are used for mounting the housing to the backing plate 14. Ambient air from the air cleaner 10 enters the air intake opening 32 and exits the housing at the outlet 34 which mates with the secondary plenum chamber 17.

Figure 6:
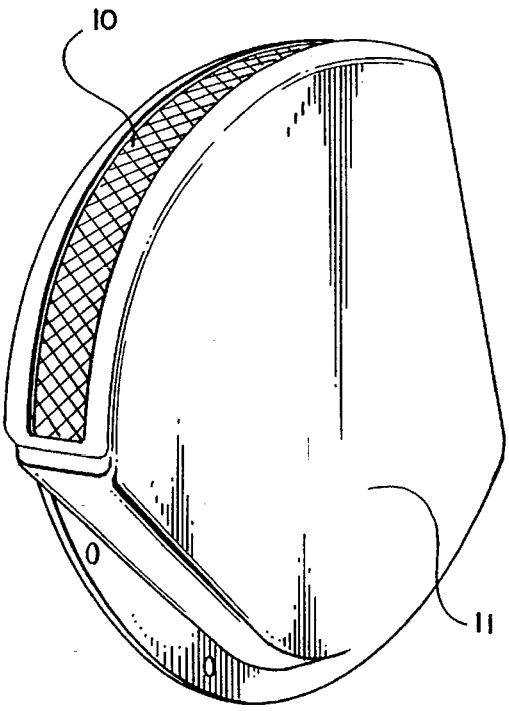
FIG. 6 is a perspective view of the air cleaner housing and the air cleaner.

FIG. 6 shows the air cleaner housing 11 and the air cleaner 10 which mount on the centrifugal compressor housing 13. The air cleaner 10 is preferably a standard circular air filter with a portion of the filter exposed to the stream of air generated by the forward velocity of the engine during operation, and the remainder of the filter located in the housing 11.

Figure 7:
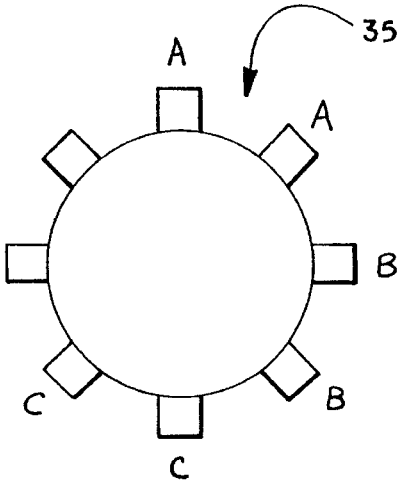
FIG. 7 is a schematic diagram of the stator for the motor driven alternator of the present invention.

FIG. 7 is a schematic of the stator 35 of the alternator for the present invention. One line (post A) is from the two post stator which is wound with small diameter wire (0.037 inch), and the second and third line (posts B and C) are from the two pairs of remaining posts which are wound with larger diameter wire (0.062 inch). All three a.c. lines 36 are then fed into the switch box module 31. The speed of the compressor is dependent on the output of the electrical stator which provides the input to the electrical d.c. motor. The stator is wound such that the maximum voltage is attained when the magnetic flywheel rotates beyond four thousand rpm. From zero to five thousand rpm, the voltage rises asymptotically from zero to over eighteen volts. The stator 35 can be modified to peak at different rpm and voltage values.

Figure 8:
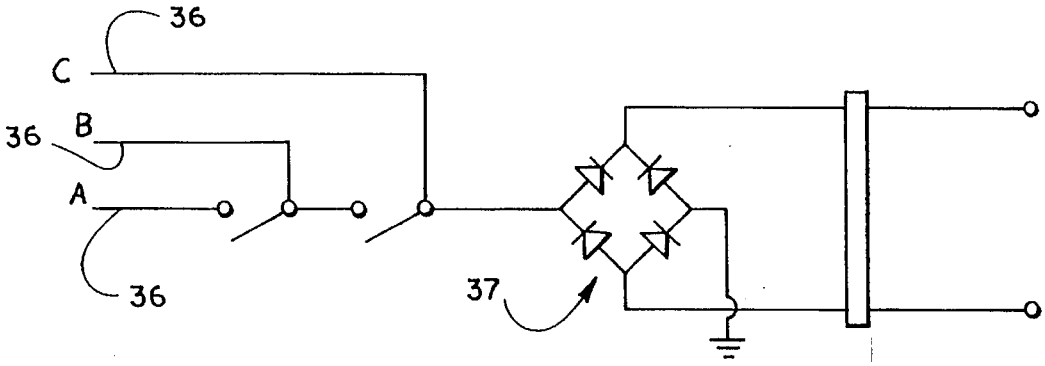
FIG. 8 is a wiring diagram for the switching station and the bridge rectifier.

FIG. 8 shows the wiring of the leads from the stator wires 36 which enter the switch box module 31 for conversion from alternating current to direct current. Two of the three stator wires 36 are switchable from on to off, whereas the third wire is always connected to a bridge rectifier 37 which converts the alternating current to direct current. The output of the bridge rectifier is wired directly to the d.c. motor 30. The current from the a.c. stator is passed through a rectifying circuit to convert a.c. to d.c. current. Post C is one hundred percent duty cycle and the wire 36 from Post C is not switchable. The wire 36 from Post B is switchable between on and off by a toggle switch. The wire 36 from Post A is also switchable between on and off by a toggle switch. As a result, there are three power levels available to the compressor unit. Also, since power from the stator/alternator is limited it is necessary to be able to switch power from the compressor to other accessories such as headlights when needed. Output from the bridge rectifier 37 in the form of d.c. current is routed to a rare earth (Cobalt) magnet d.c. motor 30. It is important to use fine stranded, multiple conductor, large diameter wire to minimize resistance losses in the line to the motor.

In FIG. 9 an exploded view of the alternator 38 and the compressor wheel 22 attached to the flywheel of the engine is shown. The magnetic flywheel 23 is connected to the crankshaft 39 of the engine. The stator 35 is positioned inside the magnetic flywheel to form the alternator 38. The backing plate 14 is mounted to the crankcase 15 of the engine. The centrifugal compressor wheel 22 bolts directly to the magnetic flywheel 23 of the engine. The maximum power of the stator of the present invention is two hundred and fifty watts. There are no practical battery designs taking into effect cost, weight, space, and charge density which can provide this much power for long duration use and are presently available to consumers. At the power consumption rates associated with the supercharger of the present invention, a typical lead acid battery for an ATV or motorcycle will last for ten minutes. Other disadvantages for the use of batteries include limited reliability, space requirements, chemical hazard, additional weight to the vehicle, finite life cycle, finite charge capacity, and additional complexity to the voltage regulation for the system. However, there may be some situations in which a battery source may be used with the present system. For instance, a battery may be used in a very short race such as a drag, or in a situation where the stator output is insufficient or the stator is not able to be modified.

Some models of engines may be limited in electrical output and incapable of modification. This problem can be avoided through substituting a d.c. generator for the belt driven compressor and bypassing the a.c. to d.c. circuit. Instead of the second mechanical compressor 26 of FIG. 4, a d.c. generator 41 with two separate outputs can be driven by the belt from the crankshaft as shown in FIG. 10. The d.c. generator 41 preferably has an output capacity of 500 watts. The power generated, which is dependent on combustion engine rpm, is preferably routed through 13 gauge multistrand flexible conducting wire 42 to an electrically driven centrifugal compressor 43. The intake 44 of the electrically driven compressor is approximately three inches in diameter and the output is diffused into the axial compressor. The electrically driven compressor unit 43 is preferably designed to draw up to 400 watts and is a higher rated motor than the axial flow compressor. With the d.c. generator 41 connected to the crankshaft, a tertiary plenum chamber 45 is added to the system.

Figure 11:
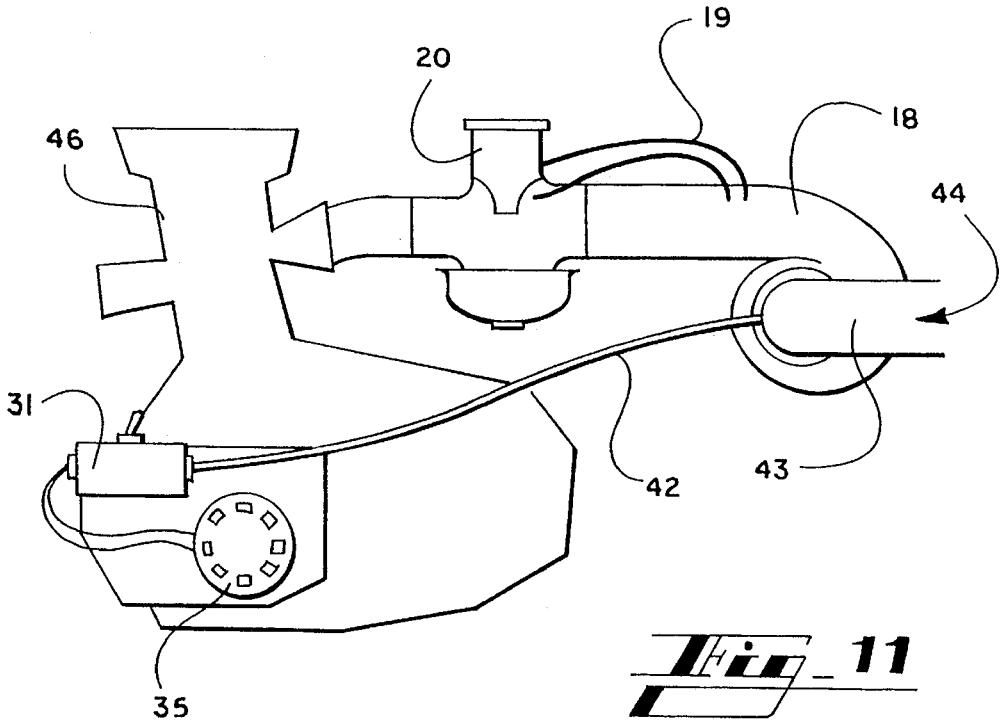
FIG. 11 is a schematic diagram of the supercharging system of the present invention equipped with an electrically driven centrifugal compressor.

FIG. 11 shows an alternate embodiment of the present invention in which the stator 35 provides an a.c. current to the manual switching station 31. The manual switching includes toggle switches for different amounts of input from the stator 35 and includes a bridge rectifier 37 (best illustrated in FIG. 8) to convert the a.c. current to d.c. current.

A portion of the d.c. current depending on the position of the toggle switches is routed through multistrand conducting wire 42 to the electrically driven centrifugal compressor unit 43. The intake 44 of the electrically driven compressor allows ambient air to enter the system for compression. The outlet of the centrifugal compressor mates with the primary plenum chamber 18. In order to balance the pressures between the primary plenum chamber and the carburetor float bowl, pressure equalization tubes 10 connect the primary plenum chamber to the carburetor 20. After the fuel and compressed air is combined in the carburetor 20, the air/fuel mixture enters the crankcase of the two-stroke cycle engine from where it enters the combustion chamber 46 for ignition.

Figure 12:
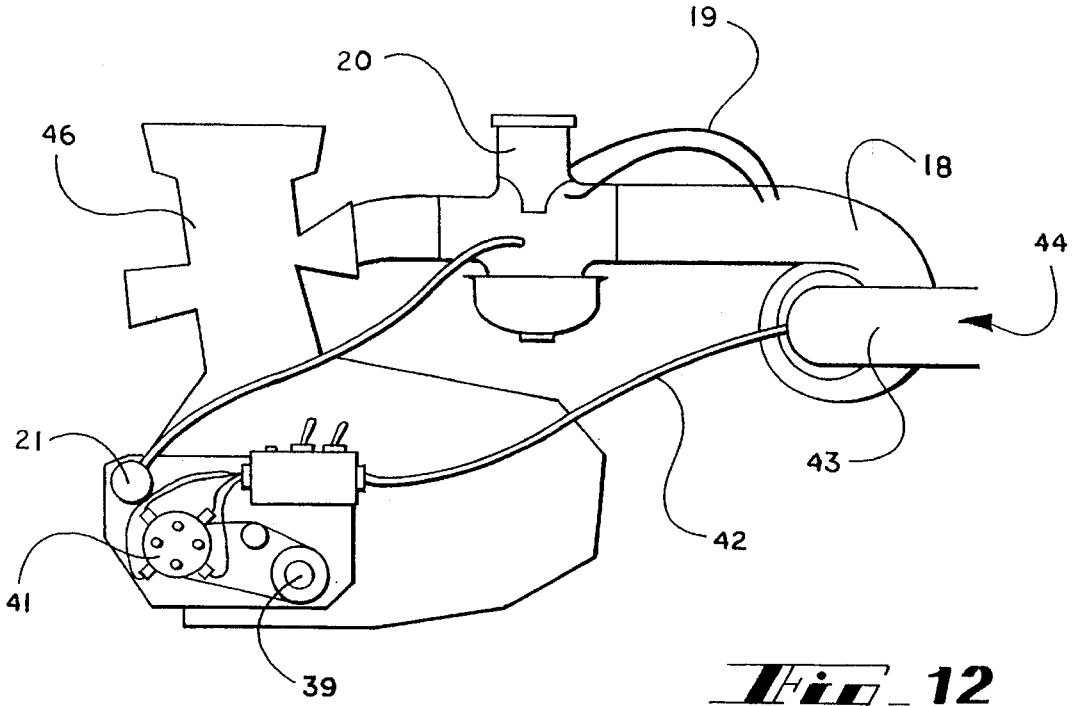
FIG. 12 is a schematic diagram of the supercharging system of the present invention equipped with a belt driven d.c. generator which powers an electrically driven centrifugal compressor.

FIG. 12 shows an embodiment of the present invention which satisfies the conditions where both space and electrical power are limited, if the stock alternator cannot be modified to provide for the additional electrical power required for the electrically driven compressor unit 43, a belt driven d.c. generator 41 can be connected to the crankshaft 39. The output from the d.c. generator is routed through multiple strand conducting wire 42 to the compressor unit 43. The intake 44 allows ambient air to enter the system. The outlet of the electrically driven centrifugal compressor unit 43 mates with the primary plenum chamber 18. As in the embodiment shown in FIG. 11, the pressure equalization tubes 19 provide for balancing of the pressures between the primary plenum chamber 18 and the carburetor 20. After the air-fuel mixture enters the crankcase from the carburetor, the mixture is conveyed into the combustion chamber 46 by the pressure differential created by the downward stroke of the piston.

Various modifications may be made of the invention without departing from the scope thereof and it is desired, therefore, that only such limitations shall be placed thereon as are imposed by the prior art and which are set forth in the appended claims.

What is claimed is:

1. A multiple stage supercharging system for an internal combustion engine, the engine having a carburetor with an air intake snorkel, a gas tank, a magnetic flywheel, and a crankcase, the supercharging system comprising:

a backing plate attached to the crankcase of the engine, a centrifugal compressor housing having an air intake and an outlet, the centrifugal compressor housing mounted on the backing plate, a centrifugal compressor wheel attached to the magnetic flywheel of the engine, the centrifugal compressor wheel positioned inside the centrifugal compressor housing, air filter means for filtering ambient air entering the air intake of the centrifugal compressor housing, a secondary plenum chamber having an inlet and an outlet, the inlet mating with the outlet of the centrifugal compressor housing, a d.c. motor driven axial compressor having an inlet and an outlet, the inlet mating with the outlet of the secondary plenum chamber, a primary plenum chamber having an inlet and an outlet, the inlet mating with the outlet of the d.c. motor driven axial compressor, the outlet of the primary plenum chamber mating with the air intake snorkel to the carburetor, a pressure equalization tube extending from the primary plenum chamber to the carburetor, an electric fuel pump having a first line and a second line, the first line connected to the gas tank and the second line connected to the carburetor, alternator means for producing alternating current from the rotation of the magnetic flywheel, the alternator means surrounding the magnetic flywheel, and alternating current to direct current conversion means for converting the current from the alternator to a direct current, the direct current connecting to the d.c. motor driven axial compressor.

2. The supercharging system of claim 1 further comprising a wire mesh screen located inside the primary plenum chamber.

3. The supercharging system of claim 1 further comprising air scoop means for collecting air generated by the forward velocity of the engine, the air scoop means connected to the air filter means, the air scoop means comprising an air cleaner housing connected to the centrifugal compressor housing, the air cleaner housing enclosing the air intake of the centrifugal compressor housing, and the air filter means comprises an air cleaner located inside the air cleaner housing, the air cleaner having a first section enclosed by the air cleaner housing, the air cleaner having a second section exposed to ambient air.

4. The supercharging system of claim 1, wherein the alternator means comprises:

a first stator having a first post and a second post, a second stator having a third post and a fourth post, a third stator having a fifth post and a sixth post, a first stator wire connected to the first and second post of the first stator, a second stator wire connected to the third and fourth posts of the second stator, a third stator wire connected to the fifth and sixth posts of the third stator, a manual switching station having a first on\off switch and a second on\off switch, the first on\off switch connected to the first stator wire, the second on\off switch connected to the second stator wire, and a bridge rectifier.

5. The supercharging system of claim 4, wherein the bridge rectifier further comprises a 25 amp bridge rectifier.

6. The supercharging system of claim 4, wherein the first stator further comprises the first post and the second post each having sixty turns of approximately 0.037 inch diameter wire.

7. The supercharging system of claim 4, wherein the second stator further comprises the third post and the fourth post each having forty-two turns of approximately 0.062 inch diameter wire.

8. The supercharging system of claim 4, wherein the third stator further comprises the fifth and sixth post each having forty-two turns of approximately 0.062 inch diameter wire.

9. The supercharging system of claim 1 further comprising the centrifugal compressor wheel being constructed of cast aluminum, the centrifugal compressor wheel having a diameter of approximately 6.7 inches and having twelve blades, and the centrifugal compressor wheel weighing ten ounces.

10. The supercharging system of claim 1 further comprising the centrifugal compressor housing having a round opening with a diameter of approximately 3.6 inches.

11. The supercharging system of claim 1, wherein the axial compressor further comprises an aluminum compressor wheel having a hub, the compressor wheel having six blades, the blades being spaced at sixty degree intervals around the hub, the compressor wheel having six partial blades spaced between each of the blades, the compressor wheel weighing approximately 1.5 ounces, a d.c. motor connected to the hub of the compressor wheel, and a d.c. motor tripod providing support for the motor.

12. The supercharging system of claim 11, wherein the d.c. motor further comprises:

an output shaft having a diameter of approximately 0.156 inches, a round motor housing constructed of aluminum, a motor armature, the armature having seven skewed slotted sectors, the sectors being wound with ten turns of 21 AWG single strand copper wire, a magnetic housing surrounding the armature, the magnetic housing having a barrel, the barrel having an outside diameter of approximately 1.32 inches, a first bank of rare earth magnets positioned inside the motor housing, a second bank of rare earth magnets positioned in the motor housing opposite the first bank of magnets, and two silver graphite brushes.

13. A multiple stage supercharging system for an internal combustion engine, the engine having a carburetor with an air intake snorkel, a gas tank, a magnetic flywheel, a crankshaft and a crankcase, the supercharging system comprising:

a backing plate attached to the crankcase of the engine, a centrifugal compressor housing having an air intake and an outlet, the centrifugal compressor housing mounted on the backing plate, a centrifugal compressor wheel attached to the magnetic flywheel of the engine, the centrifugal compressor wheel positioned inside the centrifugal compressor housing, a d.c. generator having a first output of current, a second output of current and a sheave, the sheave connected to the crankshaft of the engine by a belt, air filter means for filtering the ambient air entering the air intake of the centrifugal compressor housing by the air scoop means, a secondary plenum chamber having an inlet and an outlet, the inlet mating with the outlet of the centrifugal compressor housing, a d.c. motor driven centrifugal compressor having an inlet and an outlet, the inlet mating with the outlet of the secondary plenum chamber, the d.c. motor driven centrifugal compressor being powered by the current from the first and second outputs of the d.c. generator, a primary plenum chamber having an inlet and an outlet, the inlet mating with the outlet of the d.c. motor driven centrifugal compressor, the outlet of the primary plenum chamber mating with the air intake snorkel to the carburetor, a pressure equalization tube extending from the primary plenum chamber to the carburetor, and an electric fuel pump having a first line and a second line, the first line connected to the gas tank and the second line connected to the carburetor.

14. The supercharging system of claim 12 further comprising a wire mesh screen located inside the primary plenum chamber.

15. The supercharging system of claim 13 further comprising the centrifugal compressor wheel being constructed of cast aluminum, the centrifugal compressor wheel having a diameter of approximately 6.7 inches and having twelve blades, and the centrifugal compressor wheel weighing ten ounces.

16. The supercharging system of claim 13 further comprising the centrifugal compressor housing having a round opening with a diameter of approximately 3.6 inches.

17. A supercharging system for an internal combustion engine, the engine having a carburetor with an air intake snorkel, a gas tank, a magnetic flywheel and a crankcase, the supercharging system comprising:

a plenum chamber having an inlet and an outlet, the outlet of the plenum chamber mating with the air intake snorkel to the carburetor, a d.c. motor driven centrifugal compressor having an air intake and an outlet, the outlet mating with the inlet of the plenum chamber, air filter means for filtering the ambient air entering the air intake of the d.c. motor driven centrifugal compressor, alternator means for producing alternating current from the rotation of the magnetic flywheel, the alternator means surrounding the magnetic flywheel, a first stator having a first post and a second post, a second stator having a third post and a fourth post, a third stator having a fifth post and a sixth post, a first stator wire connected to the first and second post of the first stator, a second stator wire connected to the third and fourth posts of the second stator, a third stator wire connected to the fifth and sixth posts of the third stator, a manual switching station having a first on\off switch and a second on\off switch, the first on\off switch connected to the first stator wire, the second on\off switch connected to the second stator wire, a bridge rectifier, alternating current to direct current conversion means for converting the current from the alternator means to a direct current, the direct current connected to the d.c. motor driven centrifugal compressor, a pressure equalization tube extending from the plenum chamber to the carburetor, and an electric fuel pump having a first line and a second line, the first line connected to the gas tank and the second line connected to the carburetor.

18. The supercharging system of claim 17, wherein the bridge rectifier further comprises a 25 amp bridge rectifier.

19. The supercharging system of claim 17, wherein the first stator further comprises the first post and the second post each having sixty turns of approximately 0.037 inch diameter wire.

20. The supercharging system of claim 17, wherein the second stator further comprises the third post and the fourth post each having forty-two turns of approximately 0.062 inch diameter wire.

21. The supercharging system of claim 17, wherein the third stator further comprises the fifth and sixth post each having forty-two turns of approximately 0.062 inch diameter wire.

* * * * *